US007832348B2

(12) United States Patent
Newcomb

(10) Patent No.: US 7,832,348 B2
(45) Date of Patent: Nov. 16, 2010

(54) EMERGENCY WATERCRAFT

(76) Inventor: Richard Newcomb, 5004 Mt. Zion Rd., Hurlock, MD (US) 21643

( * ) Notice: Subject to any disclaimer, the term of this patent is extended or adjusted under 35 U.S.C. 154(b) by 0 days.

(21) Appl. No.: 12/257,431

(22) Filed: Oct. 24, 2008

(65) Prior Publication Data

US 2009/0145345 A1 Jun. 11, 2009

Related U.S. Application Data

(60) Provisional application No. 60/982,586, filed on Oct. 25, 2007.

(51) Int. Cl.
*B63B 21/56* (2006.01)

(52) U.S. Cl. ..... 114/248; 114/362

(58) Field of Classification Search ..... 114/61.1, 114/61.2, 242, 248, 343, 362
See application file for complete search history.

(56) References Cited

U.S. PATENT DOCUMENTS

| | | | | |
|---|---|---|---|---|
| 3,659,546 | A * | 5/1972 | Miklos | 114/248 |
| 3,726,245 | A * | 4/1973 | Critcher | 114/61.1 |
| 4,836,298 | A | 6/1989 | Laboureau | |
| 5,248,271 | A | 9/1993 | Chu | |
| 5,354,222 | A | 10/1994 | Elias | |
| 5,809,923 | A | 9/1998 | Yilmaz | |
| D438,506 | S | 3/2001 | Munson | |
| 6,352,460 | B1 | 3/2002 | Eiband et al. | |
| 6,868,799 | B2 * | 3/2005 | Wright | 114/343 |
| 7,028,632 | B2 * | 4/2006 | Blank | 114/362 |
| 7,134,400 | B2 * | 11/2006 | Blank | 114/362 |
| 7,137,350 | B2 | 11/2006 | Waldock | |
| 7,182,033 | B1 * | 2/2007 | Phillips et al. | 114/248 |
| 7,185,599 | B1 * | 3/2007 | Griffiths et al. | 114/248 |
| 7,247,070 | B2 | 7/2007 | Boice | |
| 2007/0283869 | A1 * | 12/2007 | Quinn | 114/248 |

* cited by examiner

*Primary Examiner*—Lars A Olson
(74) *Attorney, Agent, or Firm*—McHale & Slavin, P.A.

(57) ABSTRACT

Disclosed is a watercraft for use in combination with a PWC or suitable shallow draft propulsion system. The watercraft is designed to operate in emergency conditions where flood waters leave an uncharted bottom that may be as little as twelve inches deep or conceal a submerged object. The watercraft includes a ramp allowing for the ease of loading including wheelchair bound and bed-bound patients as well as supplies such as water, food, medical supplies, generators, and water filtration systems. The watercraft is based upon two pontoons having a storable floor and support structure, the support structure overlays a portion of each pontoon.

13 Claims, 7 Drawing Sheets

EMERGENCY WATERCRAFT

PRIORITY CLAIM

This application claims a filing date of Oct. 25, 2007 based upon U.S. Provisional Application No. 60/982,586 the contents of which are incorporated herein by reference.

FIELD OF THE INVENTION

This invention relates to the field of emergency rescue devices and more particularly to an emergency watercraft being capable of carrying a large amount of people or supplies in shallow water conditions during evacuation or other emergency situations.

BACKGROUND OF THE INVENTION

Evacuation of citizens from flooding conditions has always been problematic. The problems were well illustrated during the flooding of New Orleans in the aftermath of Hurricane Katrina. In this situation a large portion of the population were stranded in waters that may be shallow in some areas, but otherwise posed a dangerous risk due to contaminated water concealing submerged objects and low power lines. Even if the water was considered deep, the use of conventional watercraft proved to be most problematic as the outboard engines would strike a submerged obstacle such as a mailbox, automobile, and so forth. A conventional outboard engine is designed for navigable waters. If an outboard engine strikes an object, the propeller is designed to spool which protects the drive shaft but renders the motor useless for propulsion. Having personally spent nearly thirty years in the Coast Guard, I am well aware of the dangerous conditions facing emergency evacuations and the lack of proper evacuation equipment.

Unique to the boating industry is the Personal Water Craft (PWC) which relies upon a propulsion system capable of operating in shallow water by use of a jet drive. Jet drives employ an inboard engine that drives a pump jet having a screw shaped impeller to create thrust for propulsion and steering. The PWC, also known by some of the brand names such as Wave Runner, Jet Ski, or Sea-Doo are designed to carry only one or two people at a time. In an emergency situation, such as Katrina where flood waters were rising, the PWC provided the ideal propulsion system but lacked the capacity to evacuate the large amount of people in a short period of time. For these reasons, helicopters were brought in making evacuation extremely risky (i.e. hoisting cable in close proximately to a power line) and expensive.

PWC are very affordable and sold in such large numbers that a new for sale or used/private PWC can be found in most any neighborhood. Thus, while a propulsion system has been found to be readily available within a given area, it lacks the ability to move a large amount of people in a short amount of time.

Various attempts to provide watercraft for shallow use can be found in the following patents. U.S. Pat. No. D438,506 discloses an ornamental design for a tunnel hull catamaran landing craft.

U.S. Pat. No. 4,836,298 discloses catamaran type boat mechanically propelled by an outboard motor comprising two floats, which are identical, coplanar and parallel, and a seat of the motor which are maintained rigidly together. Two transverse bars perpendicular to the axis of the floats are connected at their centers by a longitudinal member extending between the two floats. Two lateral bows fastened with the seat extend on either side up to the front transverse bar lower and upper fairings completing the boat by constituting a place to sit and for control.

U.S. Pat. No. 5,354,222 discloses a water rescue sled having a buoyant body for towing an incapacitated victim behind a personal watercraft. A coupling attaches the buoyant body to the personal watercraft providing at least two degrees of freedom so as to minimize stress to both the personal watercraft and the rescue sled during use. The water rescue sled further comprises a plurality of ties for securing a victim to the buoyant body. The sled may function as a backboard for maintaining the spine in a straight and immobile configuration during transport if the ties are configured as handles. Ropes or the like may be attached to the ties and placed over the victim so as to maintain the victim safely upon the upper surface of the buoyant body.

U.S. Pat. No. 6,352,460 discloses a neutral buoyancy recovery device (NBRD) for retrieving an immobile object or incapacitated individual from a liquid area using neutral buoyancy. The NBRD is easily submerged and placed under an object to be recovered. At least one bladder attached to the NBRD is inflated, manually or by compressed gas, to create positive buoyancy and propel the object to the surface. The bladder(s) is located in a space between two panels, which are connected to form one unit. Various straps and ropes are used to stabilize the object or individual as the NBRD is maneuvered through the surface.

U.S. Pat. No. 7,137,350 discloses a catamaran having a pair of spaced-apart pontoons, each having a forward tapered and a rearward end. An underwing is affixed to the pontoons and spans therebetween. A platform is pivotally connected to the underwing and conforms to the pontoons at their forward tapered end or their rearward end. A power assembly is connected to the platform for adjustment to/from a stowed position to/from a plurality of working positions, including below the waterline. The platform may also carry a deployable extending ramp with a walkway formed by floating for protecting the craft from damage.

U.S. Pat. No. 5,809,923 discloses a buoyant and adjustable vessel for navigation in shallow and deep waters without changing the total vessel weight. The sea keeping characteristics and dynamic stability of the vessel are also managed by changing the shape of the buoyancy and controlling corresponding wet vertical depth necessary for safe operations and navigation.

U.S. Pat. No. 7,247,070 discloses an ice rescue craft including a plurality of locking raft sections that are foldable for storage and transport. A drive unit includes a drive wheel driven by an electric motor which may include a plurality of spikes configured to engage ice and a plurality of paddles that are centripetally urgeable outward to pull the rescue craft through water. A forward raft section may include a pair of outboard pontoons to provide stability and minimize lateral rocking. An aft raft section includes at least one rudder mounted to a plate on a pivoting, biased system. The rudders automatically fold upwardly when on solid surface or downwardly while in water.

U.S. Pat. No. 5,248,271 discloses a built-up watercraft including a body consisted of three base boards hinged together and bilaterally supported on two floats by two wings, two propeller runners bilaterally coupled to a transmission mechanism mounted on the body at the back, a rudder assembly fastened to the body below the transmission mechanism, a steering wheel assembly mounted on the body at the front and driven to adjust the direction of the rudder assembly. The three base boards of the body and the wings are folded up and formed into the shape of a case as the watercraft is not in use.

Connecting tubes are made on the wings and the body for permitting a plurality of watercrafts of the same structure to be connected in series as well as in parallel by flexible connecting rods.

Thus, what is lacking in the art is a means for moving a large amount of people or supplies using a propulsion system as low cost and reliable as a PWC.

SUMMARY OF THE INVENTION

Disclosed is an emergency watercraft device that can be easily shipped in a disassembled or partially-disassembled state and can be assembled in as little as twenty minutes with a single-size tool and suitable air pump. The watercraft can be coupled to a propulsion system such as a Personal Water Craft (PWC), Jet type outboard engine or other shallow draft prime mover and allows upward of thirty people to be evacuated yet draws less than fourteen inches of water while fully loaded. The watercraft of the instant invention is primarily designed to be secured to any style PWC through means of a shape adaptive transom system. This allows the instant invention to be equipped with a PWC or provides a platform that allows the government to claim rights to any available PWC during an emergency situation. Other types of shallow draft propulsion units may be utilized by means of an optional, solid type, conventional transom panel. The watercraft can also be used for carrying animals and supplies into waters that were otherwise of minimal depth or with such obstructions that a conventional outboard engine would be damaged or destroyed.

The watercraft of the instant invention provides accessibility and stability so as to carry individuals that otherwise would not be possible to be placed upon personal watercraft such as wheelchair and bed-bound patients. Further, the stability of the instant invention allows the delivery of critical supplies such as water, food, generators, water filtration systems, and fuel in flood or shallow draft areas that were otherwise only accessible by air drop.

Thus, an objective of the instant invention is to provide a watercraft capable of transporting a large amount of personnel, equipment or supplies in shallow water when used in combination with a personal watercraft or other shallow draft design propulsion system.

Still another objective of the instant invention is to provide a watercraft capable of attaching to any available PWC for use in maneuvering in extremely shallow water or in water having submerged obstacles thereby providing a vehicle for emergency use where conventional propulsion systems could not operate.

Still another objective of the instant invention is to provide a watercraft having a ramp specifically designed to allow the loading and unloading of individuals that may not otherwise be capable of standing on a watercraft due to a physical condition.

Still another objective of the instant invention is to provide a watercraft capable of being coupled to any type of personal watercraft with minimal effort.

Still another objective of the instant invention is to provide a watercraft that can be compactly stored and assembled with minimal tools.

Yet still another objective of the instant invention is to provide a watercraft that can operate within a few inches of water and be deployed from a suitable fixed wing cargo aircraft, helicopter, or trailer.

Still another objective is to provide a watercraft having no rigid contact points on the outboard pontoons allowing for rafting against objects without damaging the object, or rubbing against a live being without injury to the individual or animal.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objectives and features thereof.

DETAILED DESCRIPTION OF THE PREFERRED EMBODIMENT

Figure 1:
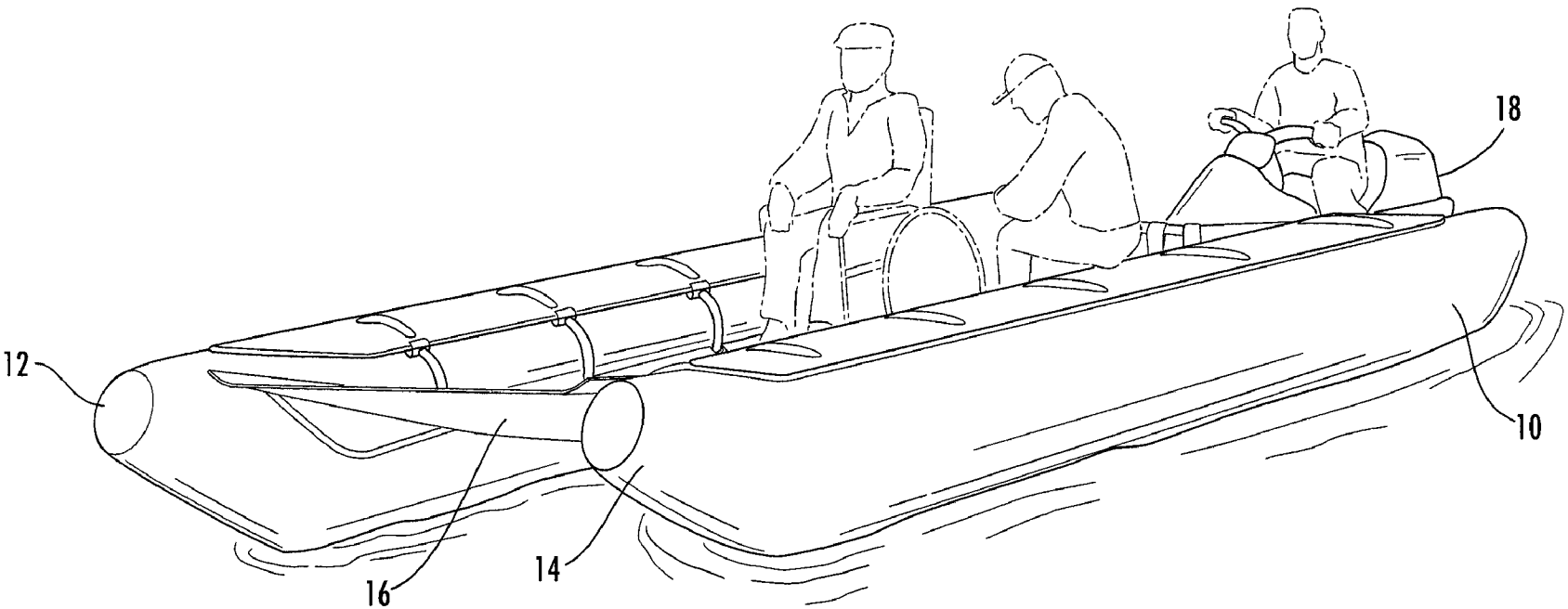
FIG. 1 is a pictorial view of the watercraft.
Figure 2:
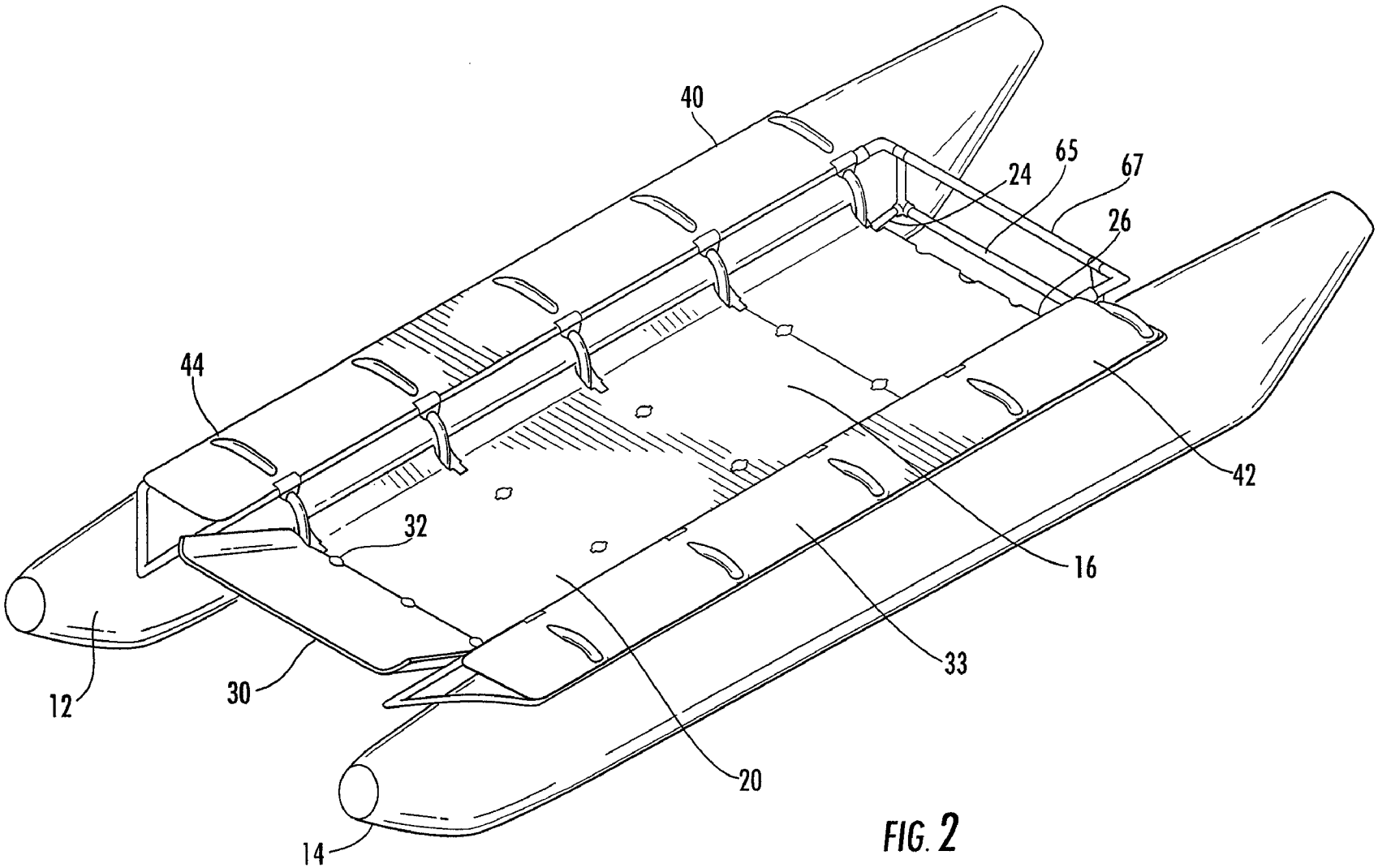
FIG. 2 is a perspective view of the watercraft without the propulsion system.

Now referring to FIGS. 1-3 and 5, set forth is a pictorial view of the watercraft (10) having a first pontoon (12) spaced apart from a second pontoon (14) with a transport support section (16) located therebetween. A PWC (18) is depicted at the rear of the watercraft and allows for propulsion in minimal draft areas. Additional capacity can be obtained by adding one to four pontoons under the deck.

The transport section includes a floor (20) for primary support of the load to be transferred and is preferably constructed of metal such as aluminum or galvanized sheet steel. Alternative, a flexible material such as canvas by being drawn between the supports providing lightweight base, although not as rigid thereby limiting the watercraft to the movement of ambulatory or stretcher born people.

The base is provided with rigid support by the use of a tubular frame, preferably constructed of aluminum pipe shown by longitudinal runner (24) positioned along pontoon (12) with a second longitudinal runner (26) positioned along pontoon (14). Alternatively, the base may be made of a light weight singular unit of composite material or metal, such as aluminum, or thin galvanized steel in instances where additional, full size, storage space is available. In either floor construction embodiment, the primary purpose of the base (16) is to allow obstruction-free loading and unloading of personnel and cargo and for individuals to safely traverse the floor. Obviously if the watercraft is used with movement of farm animals, the skid resistant metal floor provides the necessary support for sharp hoofs. Lower tubular cross member (31 and 65), upper tubular cross member (67) and forward ramp (30), while in stowed position, provide cross support.

A ramp (30) is attached to the base (16) by a hinge (32) allowing rotation from a raised storage position to a lowered access position and any position between. The ramp (30) allows ease of ingress or egress by individuals with physical aliments that may otherwise have difficulty stepping over the pontoons for entrance into the watercraft. In addition, the ramp is positioned so as to allow a PWC to placed at the rear of the watercraft to stay in as deep of water as possible while the ramp is positioned as close as possible to dry land to allow ease of access for wheelchair or bed bound personnel or heavy objects such as generators, water purification equipment or movement of food supplies.

The base (16) and ramp (30) are supported by pontoons (12 and 14) by use of longitudinal bolt rope attachment flanges and overlapping engagement assemblies (40 and 42) or the like structure. The assemblies are constructed from plurality of tubular supports (44) that formed into a curvature that follows the shape of the pontoon. In this manner when weight is placed on the floor, tubular supports (44), or the like structure, firmly increase the grasp on the pontoons effectively locking them in position and creating greater, captive, stability of the pontoons with the larger weight.

Figure 3:
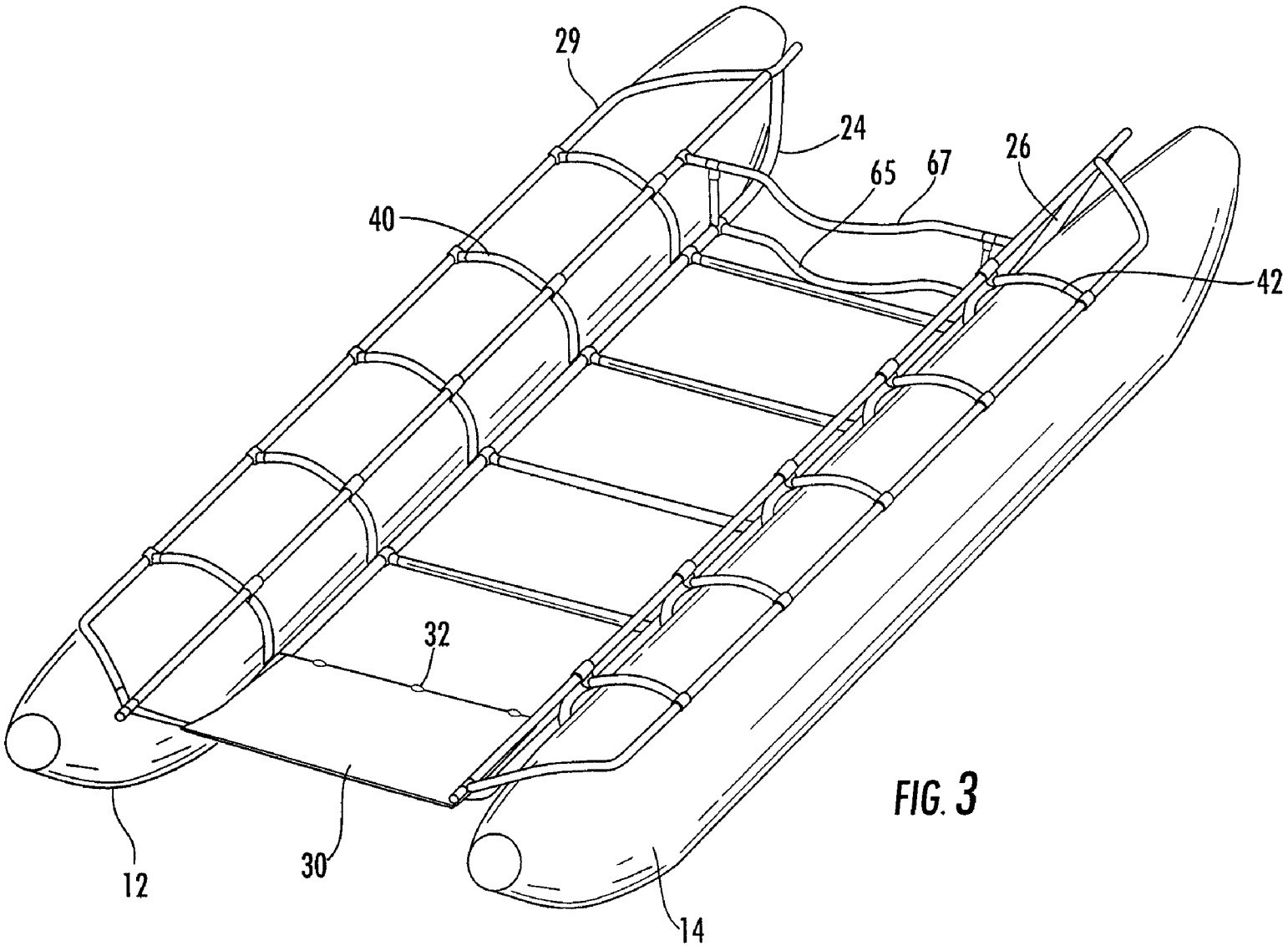
FIG. 3 is a perspective view of the watercraft without the metal platform.

FIG. 3 depicts another embodiment of the tubular frame shown by lateral runner (24) positioned along pontoon (12) with a second lateral runner (26) positioned along pontoon (14). The ramp (30) is attached to the base by the hinge (32) allowing rotation from a raised storage position to a lowered access position and any position between. The hinge is designed to provide for smooth traversing across the full width of its installation. The pontoons (12 and 14) employ the overlapping engagement assemblies (40 and 42) as previously described.

Figure 4:
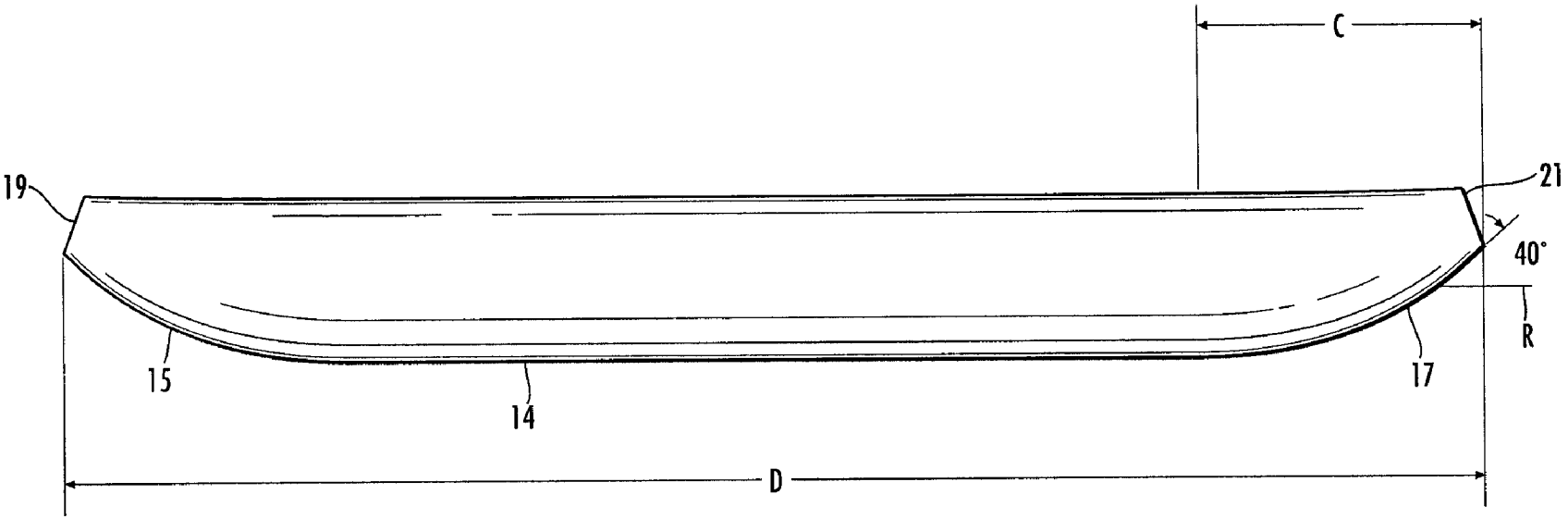
FIG. 4 is a side view of a pontoon for the watercraft.

FIG. 4 sets forth a cross-sectional side view of the pontoon (14) depicting a preferred length (D) with approximately 21 feet with each riser (15 and 17) forming an upward curvature (R) of about 40 degrees to allow the ends of the pontoon to be positioned above the debris and waterline. The preferred tube size of the pontoon is about 28 inches with each end (19 and 21) of about 10 inches with a 20 degree break. This swept or off-vertical pontoon-end design allows for increased steerage loading on the inside of a tracking curve as the radius of the transit-track becomes tighter. This is critical to the ability of multiple, connected, like-watercraft to track one another in true serpentine manner when towed. The curvature (C) of each pontoon end (15 and 17) starts at about four to five feet from each end. It should be noted that the configuration allows for scalability wherein the length of the watercraft can be increased or decreased in increments, in this example 3 ft increments. D-rings or the like can be placed along each pontoon to allow multiple watercraft to be rafted together wherein a single propulsion unit or PWC may push or pull multiple watercraft.

Figure 5:
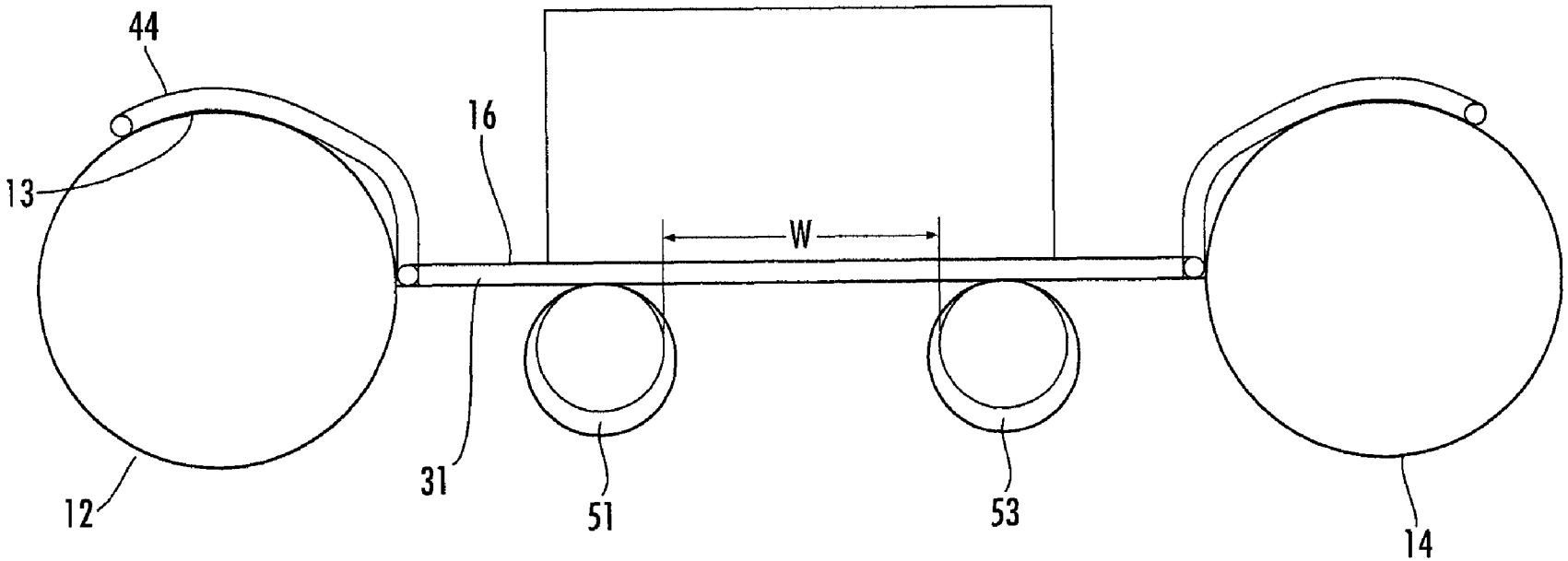
FIG. 5 is a cross-sectional end view of the watercraft.

FIG. 5 illustrates the end view of the watercraft with pontoons (12 and 14) further depicting the tubular supports (44) that curve over the upper edge (13) of the pontoon (12) and are coupled to a cross member (31) extending beneath the floor (16). The cross member support (31) is preferably about 60 inches (W) in this configuration scale.

Figure 6:
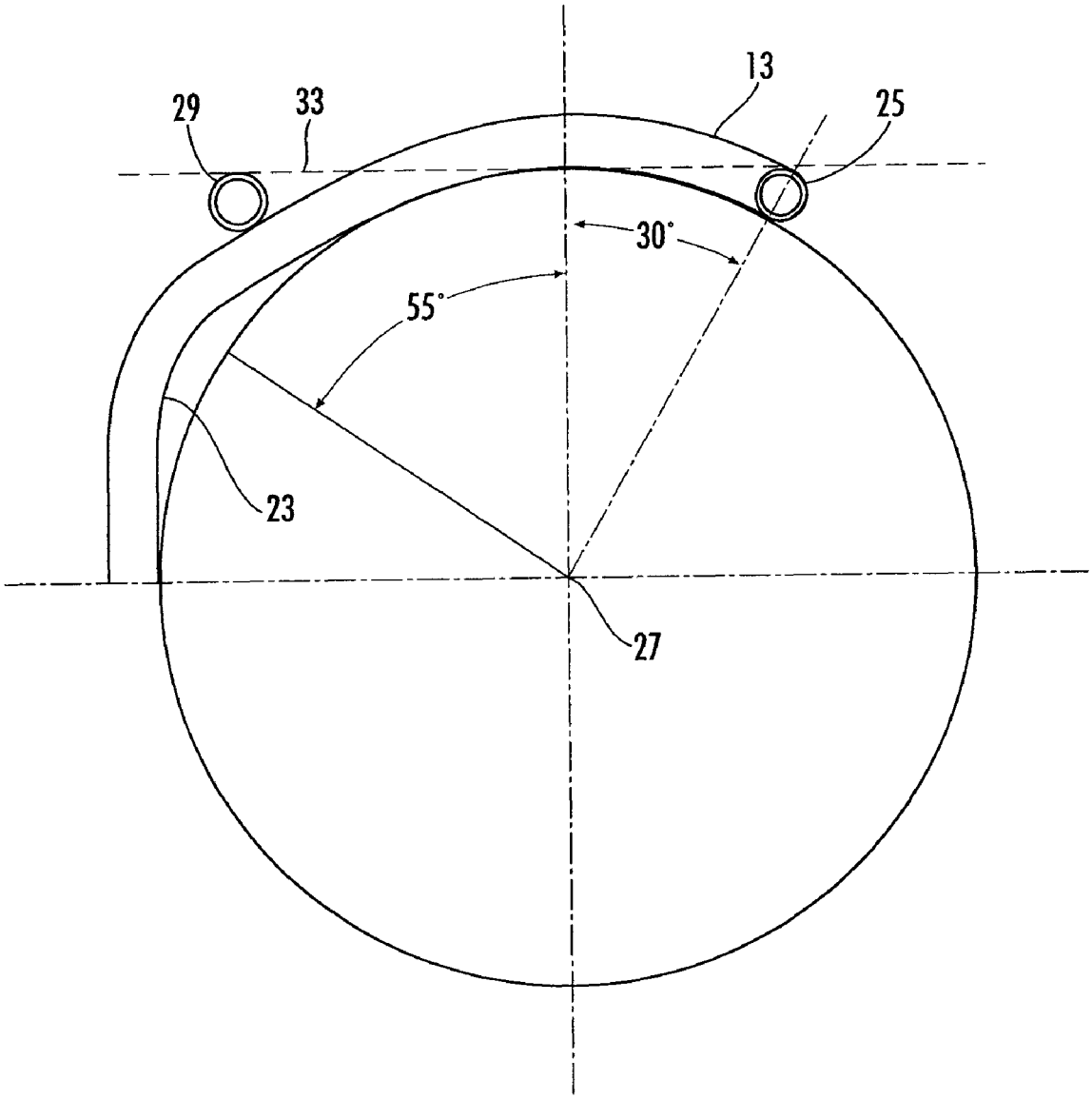
FIG. 6 is a cross-sectional end view of a pontoon with the support rod placed on the pontoon.

As shown in FIG. 6 the tubular support is preferably made out of a tubular shape so as not to cause damage to the pontoon fabric, the tubular shape is effective to distribute a load without impacting a pontoon with a sharp edge. The tubular material may also be steel but is preferably constructed out of aluminum with a shape providing an outwardly support (23) so as to accommodate placement of the inboard longitudinal support for the pontoon deck (33) which prevents direct contact with individuals against the fill valves, and protects the fill valves from impact with individuals or other objects.

Figure 7:
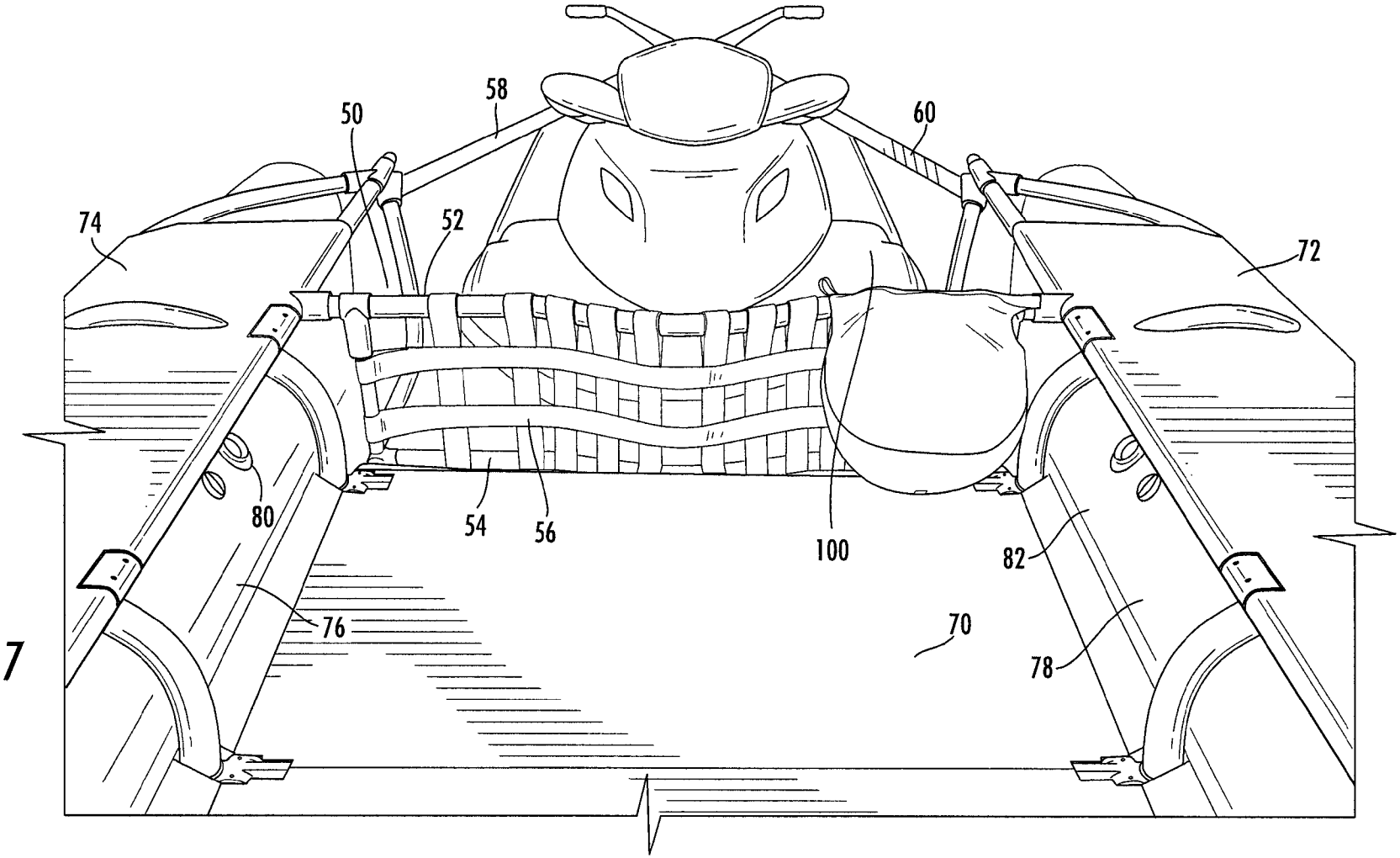
FIG. 7 is perspective view of the flexible shape adaptive transom formed along a rear portion of the transport support section.

FIG. 7 depicts the shape adaptive transom (50) having fabric webbing having an upper tubular shaped support member (52) and a lower tubular shaped frame member (54) with fabric webbing (56) secured therebetween. The fabric is positioned to engage the front of a PWC without marring the PWC. In times of an emergency, whereas the operating agency has no PWC or other suitable shallow draft propulsion unit, a PWC may be purchased, borrowed or confiscated from a local public resource. For instance, the government is ill prepared to warehouse PWCs and be able to ship them into disaster areas. The cost in storing, maintaining, and shipping internal combustion engines is cost prohibitive. Mechanical devices are better off acquired new or currently in use in order to be dependable. (A PWC that is not used results in stagnant fuel which leads to carburetor gumming and varnish residue. Even if the engine is not stored with fuel, seals and other materials may dry up resulting in a lack of dependability.) A PWC (100) is held in position by a first adjustable rearward coupling strap (58) and a second adjustable rearward coupling strap (60) allowing most any style PWC to be used for propulsion without further modifications or marring the finish of the PWC.

In the preferred embodiment, the watercraft consisting of the pontoons and base are stored in a disassembled state to minimize storage and associated transportation costs. Upon the occurrence of an emergency or natural disaster, it is well known that a community affected bands together and are willing to help their fellow neighbors. With the proliferation of PWC's, a call for assistance easily brings out those willing to lend their PWC for purposes of rescue and may even be willing to drive the PWC. For this reason, the use of the shape adapted transom allows the watercraft to accommodate most any style of PWC and minimize damage to PWC while in use.

FIG. 7 further illustrates a rigid floor (70) and the use of rigid seats (72 & 74) shown in position above pontoons (76 & 78) respectively. In the preferred embodiment, it should also be noted that the air valves (80 & 82) are located in a position that conceals the air valves from inadvertent operation, a problem typically found in air chamber pontoons that individuals can seat directly on the pontoons.

As previously stated, the shape of the support (13) provides additional engagement of the pontoon when loaded. The end (25) of the support (13) is approximately 30 degrees over the center (27) of the pontoon, thereby enabling the craft to be self fendering. The support platform can be provided from the outer edge (25) to an inner edge (29) allowing the placement of a covering (33) which is safer for individuals to sit or stand upon especially for those that are not familiar with movement on a water vessel. Increased load carrying capacity can be achieved through placement of additional pontoons (51 and 53) below the watercraft base deck or through a, unitized, composite base configuration with integral floatation.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and drawings/figures.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should by understood that the invention as claimed should not be unduly limited to such specific embodiments. Indeed, various modifications of the described modes for carrying out the invention which are obvious to those skilled in the art are intended to be within the scope of the following claims.

What is claimed is:

1. A watercraft comprising: a first pontoon spaced apart from a second pontoon by a transport support section; and a shape adaptive transom formed along a rear portion of said transport support section, said shape adaptive transom constructed from an upper, a lower, a port and a starboard tubular frame member with fabric webbing secured therebetween and receptive to a PWC for use in propulsion of the watercraft and a ramp hingedly attached to a frontal portion of said transport support section, said ramp placed in a substantially horizontal orientation to allow ease of loading said watercraft and a substantially vertical orientation for transporting of a loaded watercraft while providing stability and cross support to the forward end of the watercraft.

2. The watercraft according to claim 1 wherein said transport support section includes a plurality of overlapping engagement arms supporting a base, each said engagement arm including a pontoon engagement means releasably securable to an inner and upper surface of each said pontoon.

3. The watercraft according to claim 2 wherein said engagement arms are constructed from tubular support members.

4. The watercraft according to claim 2 wherein said engagement arms are constructed from lightweight aluminum pipe.

5. The watercraft according to claim 2 wherein said engagement arms grip the pontoons upon the placement of weight on said transport support section.

6. The watercraft according to claim 2 wherein said engagement arms extend over an upper portion of each pontoon wherein each pontoon is self fendering.

7. The watercraft according to claim 1 including a fabric floor forming a base of said transport support section.

8. A watercraft comprising: a first pontoon spaced apart from a second pontoon by a transport support section having a plurality of tubular shaped overlapping engagement arms operatively associated with said pontoons; a metal floor forming a base of said transport support section, said floor including a ramp hingedly attached to a frontal portion of said floor, said ramp placed in a substantially horizontal orientation to allow ease of loading said watercraft and a substantially vertical orientation for transporting; a flexible shape adaptive transom formed along a rear portion of said transport support section; a first rearward coupling strap for securing a PWC to a rear end a first pontoon and a second rearward coupling strap for securing the PWC to a rear end of a second pontoon; said flexible shape adaptive transom receptive to the PWC for use in propulsion of the watercraft.

9. The watercraft according to claim 8 wherein said engagement arms grip the pontoons upon the placement of weight on said transport support section.

10. The watercraft according to claim 8 wherein said engagement arms extend over an upper portion of each pontoon wherein each pontoon is self fendering.

11. The watercraft according to claim 8 including a fabric floor forming a base of said transport support section.

12. The watercraft according to claim 8 wherein each pontoon has a diameter of about 28 inches and a length of about 21 feet.

13. The watercraft according to claim 8 wherein each pontoon has about a 40 degree entry with swept off-vertical end surface design, to facilitate end loading, to provide serpentine following capability in a multiple, towed unit configuration.

* * * * *